US011591940B2

(12) United States Patent
Jonsson et al.

(10) Patent No.: US 11,591,940 B2
(45) Date of Patent: Feb. 28, 2023

(54) EMISSIONS CONTROL DEVICE COMPRISING A THREADED DISASSEMBLING ELEMENT

(71) Applicant: Scania CV AB, Södertälje (SE)

(72) Inventors: Gustav Jonsson, Södertälje (SE); Amir Halilovic, Södertälje (SE); Oskar Larsson, Ekerö (SE)

(73) Assignee: Scania CV AB, Södertälje (SE)

( * ) Notice: Subject to any disclaimer, the term of this patent is extended or adjusted under 35 U.S.C. 154(b) by 0 days.

(21) Appl. No.: 17/604,299

(22) PCT Filed: Apr. 21, 2020

(86) PCT No.: PCT/SE2020/050403
§ 371 (c)(1),
(2) Date: Oct. 15, 2021

(87) PCT Pub. No.: WO2020/218962
PCT Pub. Date: Oct. 29, 2020

(65) Prior Publication Data

US 2022/0186644 A1 Jun. 16, 2022

(30) Foreign Application Priority Data

Apr. 23, 2019 (SE) ..... 1950495-0

(51) Int. Cl.
*F01N 3/021* (2006.01)
*F01N 3/022* (2006.01)
(Continued)

(52) U.S. Cl.
CPC ..... *F01N 3/0211* (2013.01); *F01N 3/021* (2013.01); *F01N 3/022* (2013.01); *F01N 3/2839* (2013.01);
(Continued)

(58) Field of Classification Search
CPC ..... F01N 3/0211; F01N 3/021; F01N 3/022; F01N 3/2839; F01N 3/2842; F01N 13/18;
(Continued)

(56) References Cited

U.S. PATENT DOCUMENTS 3,998,599 A * 12/1976 Fedor ..... B01D 53/9431 502/200
4,355,504 A * 10/1982 Liu ..... F01N 3/01 60/275
(Continued)

FOREIGN PATENT DOCUMENTS

DE 102015003864 B3 8/2016
EP 1371825 A1 12/2003
EP 1953355 A1 8/2008

OTHER PUBLICATIONS

Scania CV AB, International Patent Application No. PCT/SE2020/050403, International Search Report, dated May 15, 2020.
(Continued)

*Primary Examiner* — Mickey H France
(74) *Attorney, Agent, or Firm* — Moore & Van Allen PLLC; W. Kevin Ransom

(57) ABSTRACT

The invention relates to an emissions control device for a combustion engine aftertreatment arrangement, the emissions control device comprising: a housing configured for accommodating an emissions control substrate; and at least one first opening in the housing, which at least one first opening is configured for receiving a threaded assembling element, which threaded assembling element is configured for assembly of the emissions control device in a cavity of the aftertreatment arrangement. The emissions control device further comprises at least one second opening in the housing, wherein the at least one second opening is provided with a thread, configured for receiving a threaded disassembling element, which threaded disassembling element is configured for disassembly of the emissions control device from the cavity of the aftertreatment arrangement. The invention further relates to a combustion engine aftertreatment arrangement for a vehicle and a method for disassembling an emissions control device.

19 Claims, 8 Drawing Sheets

(51) Int. Cl.
*F01N 13/18* (2010.01)
*F01N 3/28* (2006.01)

(52) U.S. Cl.
CPC ..... *F01N 3/2842* (2013.01); *F01N 13/18* (2013.01); *F01N 13/1827* (2013.01); *F01N 13/1805* (2013.01); *F01N 2350/00* (2013.01); *F01N 2350/02* (2013.01); *F01N 2450/02* (2013.01); *F01N 2450/16* (2013.01); *F01N 2450/24* (2013.01); *F01N 2450/30* (2013.01)

(58) Field of Classification Search
CPC ..... F01N 13/1827; F01N 13/1805; F01N 2350/00; F01N 2350/02; F01N 2450/02; F01N 2450/16; F01N 2450/24; F01N 2450/30
See application file for complete search history.

(56) References Cited

U.S. PATENT DOCUMENTS 4,828,807 A * 5/1989 Domesle ..... B01D 53/945 423/215.5
5,080,953 A * 1/1992 Horikawa ..... C04B 41/53 428/116
5,356,598 A 10/1994 Boubehira et al.
6,387,143 B1 * 5/2002 Adiletta ..... F01N 3/0212 55/497
2004/0031264 A1 * 2/2004 Kojima ..... F01N 3/0222 60/311
2005/0056008 A1 * 3/2005 Endo ..... F01N 3/021 60/311
2006/0124384 A1 6/2006 Tary et al.
2010/0024407 A1 2/2010 Merchant et al.
2011/0030353 A1 * 2/2011 Kamiya ..... F01N 3/0211 60/297
2013/0283765 A1 * 10/2013 Bucksch ..... F01N 3/2878 60/272
2014/0044612 A1 2/2014 Baig et al.
2014/0298782 A1 * 10/2014 Bucksch ..... F01N 3/035 60/324
2015/0107458 A1 4/2015 Werni et al.
2016/0341083 A1 * 11/2016 Matsunaga ..... F01N 13/1855

OTHER PUBLICATIONS

Scania CV AB, International Patent Application No. PCT/SE2020/050403, Written Opinion, dated May 15, 2020.
Scania CV AB, International Patent Application No. PCT/SE2020/050403, International Preliminary Report on Patentability, dated Sep. 28, 2021.

* cited by examiner

EMISSIONS CONTROL DEVICE COMPRISING A THREADED DISASSEMBLING ELEMENT

CROSS-REFERENCE TO RELATED APPLICATIONS

This application is a National Stage patent application (filed under 35 § U.S.C. 371) of PCT/SE2020/050403, filed Apr. 21, 2020 of the same title, which, in turn claims priority to Swedish Patent Application No. 1950495-0 filed Apr. 23, 2019 of the same title; the contents of each of which are hereby incorporated by reference.

TECHNICAL FIELD

The invention relates to an emissions control device for a combustion engine aftertreatment arrangement according to the appended claims. The invention further relates to a combustion engine aftertreatment arrangement according to the appended claims. The invention further relates to a vehicle according to the appended claims. The invention further relates to a method for disassembling an emissions control device according to the appended claims.

BACKGROUND

Combustion engines, such as diesel engines, are used in different types of machines, such as vehicles. However, the combustion engine produces emissions, containing exhaust gases and particulate matter. Various aftertreatment arrangements have been employed in exhaust systems of combustion engines to clean exhaust gases and particulate matter. Diesel particulate filters have been used to remove particulate matter from the exhaust gases emanating from diesel engines. However, substrates inside such emissions control filters may become saturated over time, because of accumulation of particulate matter and other substances on the emissions control substrates. Therefore, the emissions control substrates may need cleaning or replacement.

Disassembling and assembling an emissions control substrate for cleaning or replacement may require the use of special adapted tools. In addition, disassembling and assembling the emissions control substrate may be complicated and time consuming due to the location of the emissions control substrate in the exhaust system. The entire service process of the emissions control substrate may require a significant amount of time and access to special adapted tools, which could be costly.

The document US2010024407 A1 discloses a removable exhaust treatment unit for an aftertreatment assembly. The removable exhaust treatment unit include a housing, at least one exhaust treatment element coupled within the housing, and a flange on one end of the housing. The removable exhaust treatment unit also includes a plurality of apertures on the flange configured to receive a plurality of fasteners. The removable exhaust treatment unit further includes at least one handle coupled to the flange. A seal for axial compression is arranged between the flange and an annular support portion of an enclosure of an emission control filter assembly.

SUMMARY

Despite known solutions in the art, it is desired to achieve an emissions control dew vice for a combustion engine aftertreatment arrangement, which eliminates the need of specially adapted tools for assembling and disassembling the emissions control device in a cavity of the aftertreatment arrangement. Further, it is desired to achieve an emissions control device for a combustion engine aftertreatment arrangement, in which a sealing element of the emissions control device can be inspected when the emissions control device is assembled in a cavity of the aftertreatment arrangement. Further, it is desired to achieve an emissions control device for a combustion engine aftertreatment arrangement, in which an emissions control substrate easily can be cleaned or replaced. Further, it is desired to achieve an emissions control device for a combustion engine aftertreatment arrangement, in which a radial directed force emanating from a sealing element of the emissions control device makes the assembling and disassembling of the emissions control device in a cavity of the aftertreatment arrangement possible without specially adapted tools.

An object of the invention is therefore to achieve an emissions control device for a combustion engine aftertreatment arrangement, which eliminates the need of specially adapted tools for assembling and disassembling the emissions control device in and from a cavity of the aftertreatment arrangement.

Another object of the invention is to achieve an emissions control device for a combustion engine aftertreatment arrangement, in which a sealing element of the emissions control device can be inspected when the emissions control device is assembled in a cavity of the aftertreatment arrangement.

A further object of the invention is to achieve an emissions control device for a combustion engine aftertreatment arrangement, in which an emissions control substrate easily can be cleaned or replaced.

A further object of the invention is to achieve an emissions control device for a combustion engine aftertreatment arrangement, in which a radial directed force emanating from a sealing element of the emissions control device makes the assembling and disassembling of the emissions control device in a cavity of the aftertreatment arrangement possible without specially adapted tools.

The herein mentioned objects are achieved with an emissions control device for a combustion engine aftertreatment arrangement according to the appended claims. Further, the herein mentioned objects are also achieved with a combustion engine aftertreatment arrangement according to the appended claims. Further, the herein mentioned objects are also achieved with a vehicle according to the appended claims. Further, the herein mentioned objects are also achieved with a method for disassembling an emissions control device according to the appended claims.

According to an aspect of the invention, an emissions control device for a combustion engine aftertreatment arrangement is provided. The emissions control device comprising a housing configured for accommodating an emissions control substrate. At least one first opening is arranged in the housing, which at least one first opening is configured for receiving a threaded assembling element. The threaded assembling element is configured for assembly of the emissions control device in a cavity of the aftertreatment arrangement. The emissions control device further comprises at least one second opening in the housing. The at least one second opening is provided with a thread, configured for receiving a threaded disassembling element. The threaded disassembling element is configured for disassembly of the emissions control device from the cavity of the aftertreatment arrangement.

According to a further aspect of the invention, a combustion engine aftertreatment arrangement is provided. The combustion engine aftertreatment arrangement comprising an emissions control device disclosed herein.

According to a further aspect of the invention, a vehicle is provided. The vehicle, comprising a combustion engine aftertreatment arrangement disclosed herein.

By such emissions control device, combustion engine aftertreatment arrangement and vehicle, the need of specially adapted tools for assembling and disassembling the emissions control device in and from a cavity of the aftertreatment arrangement is eliminated. Further, the emissions control substrate of the emissions control device can easily be cleaned or replaced when the emissions control substrate has become clogged or saturated over time, because of accumulation of particulate matter and other substances on the emissions control substrate. Disassembling and assembling the emissions control substrate from and to the combustion engine aftertreatment arrangement will be easy and time efficient, since the housing configured for accommodating the emissions control substrate may be disassembled and assembled by using the threaded assembling and disassembling elements. According to an example, the assembling and disassembling elements may be threaded pins, screws and/or nuts. Thus, the entire service process of the emissions control substrate may be very time and cost efficient due to the configuration of the emissions control device and the use of threaded assembling and disassembling elements instead of special adapted tools.

According to a further aspect of the invention, a method for disassembling an emissions control device from a combustion engine aftertreatment arrangement is provided. The emissions control device comprising a housing configured for accommodating an emissions control substrate. At least one first opening is arranged in the housing, which at least one first opening is configured for receiving a threaded assembling element At least one threaded second opening in the housing is configured for receiving a threaded disassembling element. The method comprising the steps of positioning the threaded disassembling element in the at least one threaded second opening, rotating the disassembling element, so that the disassembling element moves in an axial direction towards an abutment surface of the aftertreatment arrangement, and applying a torque on the disassembling element, so that the threads of the disassembling element exerts a force on the threads of the second opening in a direction of a center axis of the second opening, which axial force pushes the emissions control device out of a cavity of the aftertreatment arrangement.

By such method for disassembling an emissions control device from a combustion engine aftertreatment arrangement, the need of specially adapted tools for disassembling the emissions control device from the combustion engine aftertreatment arrangement is eliminated. Further, the emissions control substrate of the emissions control device can easily be cleaned and replaced. The entire service process of the emissions control substrate may be very time and cost efficient due to the configuration of the emissions control device and the use of threaded assembling and disassembling elements instead of special adapted tools.

Additional objectives, advantages and novel features of the invention will be apparent to one skilled in the art from the following details, and through exercising the invention. While the invention is described below, it should be apparent that the invention may not be limited to the specifically described details. One skilled in the art, having access to the teachings herein, will recognize additional applications, modifications and incorporations in other areas, which are within the scope of the invention.

BRIEF DESCRIPTION OF THE DRAWINGS

For fuller understanding of the present disclosure and further objects and advantages of it, the detailed description set out below should be read together with the accompanying drawings, in which the same reference notations denote similar items in the various figures, and in which.

DETAILED DESCRIPTION

Figure 1:
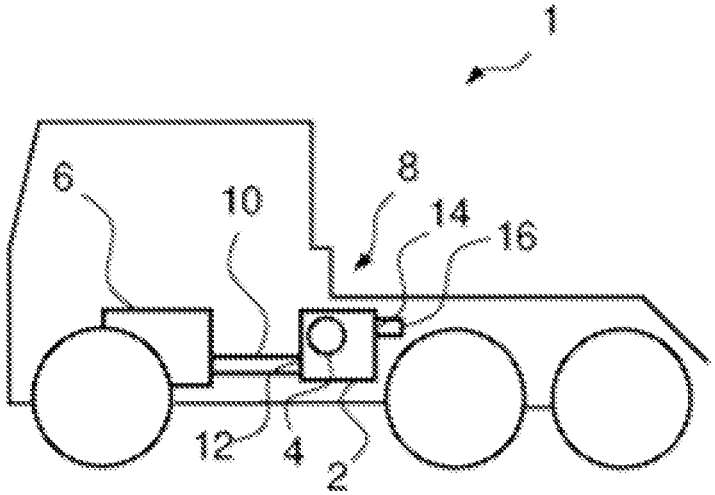
FIG. 1 schematically illustrates a side view of a vehicle with a combustion engine aftertreatment arrangement, comprising an emissions control device according to an example.

The emissions control device according to the present disclosure may be arranged in all sorts of combustion engine aftertreatment arrangements. The combustion engine aftertreatment arrangement may be a silencer, which is provided with the emissions control device. Alternatively, the emissions control device may be provided in a separate unit in in the aftertreatment arrangement, which is separated from the silencer. The emissions control device eliminates the need of specially adapted tools for assembling and disassembling the emissions control device in a cavity of the aftertreatment arrangement. Such emissions control device may contain an emissions control substrate, which can easily be cleaned or replaced. The emissions control device may comprise a sealing element, which exerts a radial directed force on the emissions control device during assembling and disassembling of the emissions control device in a cavity of the aftertreatment arrangement. However, assembling and disassembling of the emissions control device in the cavity of the aftertreatment arrangement will be possible without specially adapted tools even though the radial directed force emanating from the sealing element. The sealing element of the emissions control device can be inspected when the emissions control device is assembled in a cavity of the aftertreatment arrangement.

According to the present disclosure, an emissions control device for a combustion engine aftertreatment arrangement is provided. The emissions control device comprising a housing configured for accommodating an emissions control substrate. At least one first opening is arranged in the housing, which at least one first opening is configured for receiving a threaded assembling element. The threaded assembling element is configured for assembly of the emissions control device in a cavity of the aftertreatment arrangement. The emissions control device further comprises at least one second opening in the housing. The at least one second opening is provided with a thread, configured for receiving a threaded disassembling element. The threaded disassembling element is configured for disassembly of the emissions control device from the cavity of the aftertreatment arrangement.

The emissions control device may be a part of an exhaust system of a combustion engine, such as an otto engine or a diesel engine. The combustion engine may be arranged in different types of machines, such as vehicles. The vehicles may be heavy vehicles, such as buses, trucks etc. The emissions control device may clean exhaust gases and particulate matter emanating from the combustion engine. The emissions control device may be releasable connected to a combustion engine aftertreatment arrangement, which may be a silencer in the exhaust system of the combustion engine. However, the emissions control device may be connected directly to piping of the exhaust system or to a unit in the exhaust system, which unit is separated from the silencer.

The emissions control device comprises a housing, which may have a cylindrical configuration. However, the housing may have a configuration, which is different from the cylindrical configuration. According to an example, the housing is provided with an inlet opening for the exhaust gases and particulate matters emanating from the combustion engine. In addition, the housing is provided with an outlet opening for the exhaust gases and particulate matters emanating from the combustion engine. Thus, the housing is configured to direct a flow of exhaust gases and particulate matters from the inlet opening towards the outlet opening.

The emissions control device comprises an emissions control substrate. The emissions control substrate may be configured and adapted for the type of emissions to be treated. The emissions control substrate may be a particulate filter, which separates particles from the exhaust gases. Particulate matter may result from incomplete combustion of diesel fuel in a diesel engine. The particulate matter may be soot particles, such as black carbon. A particulate filter may be made of ceramic materials, such as cordierite filters and silicon carbide filters. However, other materials are also possible, such as metal fiber filters. The emissions control substrate may alternatively be configured to convert and clean toxic gases and pollutants in the exhaust gases from the combustion engine. Such configuration of the emissions control substrate may be a catalytic converter for reducing oxides of nitrogen the exhaust gases.

The housing is provided with at least one first opening, which is configured to receive a threaded assembling element. A number of first openings may be arranged in the housing depending on the size and shape of the housing. The threaded assembling element may be configured to connecting and attaching the housing of the emissions zo control device to the aftertreatment arrangement. In addition, the threaded assembling element may be configured to assemble the housing of the emissions control device to the aftertreatment arrangement. The thread of the threaded assembling element may be of any type and of any shape.

The aftertreatment arrangement may be provided with a cavity, which is configured to receive the emissions control device. The cavity may have size and shape corresponding to the size and shape of the housing of the emissions control device.

The housing is provided with at least one second opening, which may be provided with a thread. The thread may be arranged in the at least one second opening. Alternatively, or in combination, a threaded nut may be arranged at the at least one second opening. The threaded nut may for example be welded at the at least one second opening. The at least one second opening is configured to receive a threaded disassembling element. Since the emissions control substrates of the emissions control device may need cleaning or replacement, a threaded disassembling element may be used to disassemble the emissions control device from the aftertreatment arrangement. A number of second openings may be arranged in the housing depending on the size and shape of the housing. The thread of at least one second opening may be of any type and of any shape.

According to an example, the housing comprises a flange portion, wherein the at least one first opening and the at least one second opening are arranged in the flange portion.

The flange portion may have circular shape. The flange portion extends outwardly of the housing of the emissions control device. The housing may have a cylindrical shape with a diameter smaller than the diameter of the flange. When the emissions control device is received in the cavity of the aftertreatment arrangement, the flange portion abuts against an outside surface of the aftertreatment arrangement. The emissions control device is secured to the aftertreatment arrangement by means of the threaded assembling element received in the at least one first opening arranged in the flange portion. The flange portion is designed to withstand forces acting on the flange portion when assembling and disassembling the emissions control device in the aftertreatment arrangement. When assembling the emissions control device in the aftertreatment arrangement, forces from the threaded assembling element acting on the flange portion in the direction of the abutting surface of the aftertreatment arrangement. When disassembling the emissions control device from the aftertreatment arrangement, forces from the threaded disassembling element acting on the flange portion in the direction away from the abutting surface of the aftertreatment arrangement.

According to an example, at least two first openings are evenly distributed in the flange portion.

When the flange portion has a circular shape, the at least two first openings may be diametrically arranged in the flange portion. An evenly distribution of the at least two first openings in the flange portion will distribute the assembly force from the threaded assembling element evenly when assembling and securing the emissions control device in the aftertreatment arrangement.

According to an example, at least two second openings are evenly distributed in the flange portion.

When the flange portion has a circular shape, the at least two second openings may be diametrically arranged in the flange portion. An evenly distribution of the at least two second openings in the flange portion will distribute the disassembly force from the threaded disassembling element evenly when disassembling the emissions control device from the aftertreatment arrangement.

According to an example, the flange portion is releasably arranged on the housing.

The flange portion may be connected to and separated from the housing of the emissions control device. Such separable configuration of the flange portion may facilitate the completion of the emissions control device.

According to an example, the flange portion is a rim of a lid of the housing, the lid being releasably arranged on the housing.

Disassembling the lid from the hosing may allow access to the emissions control substrate within the housing. Further, if the sealing elements are arranged between the housing and the aftertreatment arrangement, the sealing elements may be inspected when disassembling the lid from the hosing. The lid may be releasably arranged on the housing by means of fasteners.

According to an example, the housing comprises at least one sealing element, which is provided with a radially directed sealing surface.

The radially directed sealing surface of the at least one sealing element ensures that the flow of exhaust gases and particulate matter will flow through the emissions control device without escaping from the aftertreatment arrangement before leaving the exhaust system through an exhaust pipe of the exhaust system. The radially directed sealing surface of the at least one sealing element is arranged in contact with a circumferential surface in the cavity of the aftertreatment arrangement.

According to an example, the at least one sealing element is configured to be compressed in a radial direction when assembling the emissions control device in the aftertreatment arrangement.

Compressing the at least one sealing element in the radial direction results in a radial directed force, which complicates the assembling of the emissions control device in a cavity of the aftertreatment arrangement. In order to push the housing of the emissions control device in to the cavity of the aftertreatment arrangement an axial force on the emissions control device must be applied. In the opposite, the radial directed force from the at least one sealing element will also complicate the disassembling of the emissions control device out of the cavity of the aftertreatment arrangement, since an axial force on the emissions control device must be applied in the opposite direction to the direction of the force when assembling the emissions control device in the cavity. However, the at least one first and second openings in the housing of the emissions control device makes the assembling and disassembling of the emissions control device in the cavity of the aftertreatment arrangement possible without specially adapted tools.

According to an example, the housing comprises a suspension element, which is configured to be compressed in a radial direction when assembling the emissions control device in the aftertreatment arrangement.

The suspension element may be a mesh of wires, which is circumferentially arranged about the housing of the emissions control device. During assembling of the housing in the cavity of the aftertreatment arrangement, the suspension element may be compressed similar to the at least one sealing element. The compression of the suspension element may increase the axial force acting on the housing when assembling and disassembling the housing in and from the cavity of the aftertreatment arrangement. The suspension element will center the housing within the cavity and secure that the at least one sealing element will prevent exhaust gases from passing through the sealing surfaces of the sealing element.

According to an example, the housing is a filter housing configured for accommodating a particulate filter substrate.

The housing may comprise a particulate filter substrate, which separates particles from the exhaust gases. Particulate matter in the exhaust gases may result from incomplete combustion of diesel fuel in a diesel engine. The particulate matter may be soot particles, such as black carbon. A particulate filter may be made of ceramic materials, such as cordierite filters and silicon carbide filters. However, other materials are also possible, such as metal fiber filters.

According to the present disclosure, a combustion engine aftertreatment arrangement is provided. The combustion engine aftertreatment arrangement, comprising the emissions control device disclosed herein.

The aftertreatment arrangement may be combined with a silencer. The aftertreatment arrangement may be provided with a cavity, which is configured to receive the emissions control device. The cavity may have size and shape corresponding to the size and shape of the housing of the emissions control device. The aftertreatment arrangement may be configured to treat several types of substances and particular matters in the emissions emanating from the combustion engine.

According to an example, the threaded assembling element comprises at least one threaded pin of the aftertreatment arrangement and at least one nut configured to be threaded on the threaded pin.

The threaded pin of the aftertreatment arrangement is configured to be received in the at least one first opening of the housing of the emissions control device. When threading the nut on the threaded pin, which is received in the at least one first opening of the housing, an axial force will be exerted on the housing, which axial force will push the housing in to the cavity. The thread of the threaded assembling element may be of any type and of any shape.

According to an example, the threaded assembling element comprises at least one screw, which is configured to be threaded into a threaded bore of the aftertreatment arrangement.

The screw comprises a thread and is configured to be received in the at least one first opening of the housing of the emissions control device. When threading the screw, which is received in the at least one first opening of the housing, into the threaded bore of the aftertreatment arrangement, an axial force will be exerted on the housing, which axial force will push the housing in to the cavity. The thread of the threaded assembling element may be of any type and of any shape.

According to an example, the threaded assembling element is a fastener element configured to attaching the emissions control device to the aftertreatment arrangement.

The fastener element is configured to be received in in the at least one first opening of the housing of the emissions control device. The fastener element will secure and attach the emissions control device to the aftertreatment arrangement, when the fastener element is received in the at least one first opening of the housing and secured to the aftertreatment arrangement.

According to an example, the threaded disassembling element comprises a screw. The screw is configured to be positioned in the at least one threaded second opening. When rotating the screw the disassembling element moves in an axial direction towards an abutment surface of the aftertreatment arrangement. When applying torque on the screw from a screw driver, for example, the threads of the screw will exert a force on the threads of the second opening in a direction of a center axis of the second opening, so that the axial force pushes the emissions control device out of a cavity of the aftertreatment arrangement. The thread of the threaded disassembling element may be of any type and of any shape.

According to the present disclosure, a vehicle is provided. The vehicle, comprising the combustion engine aftertreatment arrangement disclosed herein.

The combustion engine aftertreatment arrangement is applicable on all sorts of vehicles comprising a combustion engine and may thus relate to heavy vehicles, such as buses, trucks etc., which may be used on public roads and off-roads.

According to the present disclosure, a method for disassembling an emissions control device from a combustion engine aftertreatment arrangement is provided. The emissions control device comprising a housing configured for accommodating an emissions control substrate. At least one first opening is arranged in the housing, which at least one first opening is configured for receiving a threaded assembling element. At least one threaded second opening in the housing is configured for receiving a threaded disassembling element. The method comprising the steps of positioning the threaded disassembling element in the at least one threaded second opening, rotating the disassembling element, so that the disassembling element moves in an axial direction towards an abutment surface of the aftertreatment arrangement, and applying a torque on the disassembling element, so that the threads of the disassembling element exerts a force on the threads of the second opening in a direction of a center axis of the second opening, which axial force pushes the emissions control device out of a cavity of the aftertreatment arrangement.

The emissions control device may be a part of an exhaust system of a combustion engine, such as an otto engine or a diesel engine. The combustion engine may be arranged in different types of machines, such as vehicles. The vehicles may be heavy vehicles, such as buses, trucks etc. The emissions control device may clean exhaust gases and particulate matter emanating from the combustion engine. The emissions control device may be releasable connected to a combustion engine aftertreatment arrangement, which may be a silencer in the exhaust system of the combustion engine. However, the emissions control device may be connected directly to piping of the exhaust system or to a unit in the exhaust system, which unit is separated from the silencer.

The emissions control device comprises a housing, which may have a cylindrical configuration. However, the housing may have configuration, which is different from the cylindrical configuration. According to an example, the housing is provided with an inlet opening for the exhaust gases and particulate matters emanating from the combustion engine. In addition, the housing is provided with an outlet opening for the exhaust gases and particulate matters emanating from the combustion engine. Thus, the housing is configured to direct a flow of exhaust gases and particulate matters from the inlet opening towards the outlet opening.

The emissions control device comprises an emissions control substrate. The emissions control substrate may be configured and adapted for the type of emissions to be treated. The emissions control substrate may be a particulate filter, which separates particles from the exhaust gases. Particulate matter may result from incomplete combustion of diesel fuel in a diesel engine. The particulate matter may be soot particles, such as black carbon. A particulate filter may be made of ceramic materials, such as cordierite filters and silicon carbide filters. However, other materials are also possible, such as metal fiber filters. The emissions control substrate may alternatively be configured to convert and clean toxic gases and pollutants in the exhaust gases from the combustion engine. Such configuration of the emissions control substrate may be a catalytic converter for reducing oxides of nitrogen the exhaust gases.

The housing is provided with at least one first opening, which is configured to receive a threaded assembling element. A number of first openings may be arranged in the housing depending on the size and shape of the housing. The threaded assembling element may be configured to connecting and attaching the housing of the emissions control device to the aftertreatment arrangement. In addition, the threaded assembling element may be configured to assemble the housing of the emissions control device to the aftertreatment arrangement. The thread of the threaded assembling element may be of any type and of any shape.

The aftertreatment arrangement may be provided with a cavity, which is configured to receive the emissions control device. The cavity may have size and shape corresponding to the size and shape of the housing of the emissions control device.

The housing is provided with at least one second opening, which may be provided with a thread. The thread may be arranged in the at least one second opening. Alternatively, or in combination, a threaded nut may be arranged at the at least one second opening. The threaded nut may for example be welded at the at least one second opening. The at least one second opening is configured to receive a threaded disassembling element. Since the emissions control substrates of the emissions control device may need cleaning or replacement, a threaded disassembling element may be used to disassemble the emissions control device from the aftertreatment arrangement. A number of second openings may be arranged in the housing depending on the size and shape of the housing. The thread of at least one second opening may be of any type and of any shape.

Positioning the threaded disassembling element in the at least one threaded second opening comprises mating the threads of the threaded disassembling element with the threads of the at least one threaded second opening. Therefore, the threads of the threaded disassembling element should be of the same size and configuration as the threads of the at least one threaded second opening. Rotating the disassembling element after mating the the threads of the threaded disassembling element with the threads of the at least one threaded second opening, will move the disassembling element in an axial direction. Such rotating of the disassembling element may be performed by hand or by a tool of machine. Moving the disassembling element in an axial direction will result in that the disassembling element will reach an abutment surface of the aftertreatment arrangement. When applying a torque on the disassembling element abutting the abutment surface of the aftertreatment arrangement, the threads of the disassembling element will exert a force on the threads of the second opening in a direction of a center axis of the second opening. The axial force will push the emissions control device out of a cavity of the aftertreatment arrangement.

The threaded disassembling element may comprise a screw. The screw may be configured to be positioned in the at least one threaded second opening. When rotating the screw the screw will move in an axial direction towards the abutment surface of the aftertreatment arrangement. When applying torque on the screw from a screw driver, for example, the threads of the screw will exert a force on the threads of the second opening in a direction of a center axis of the second opening, so that the axial force pushes the emissions control device out of a cavity of the aftertreatment arrangement.

The thread may be arranged in the at least one second opening. Alternatively, or in combination, a threaded nut may be arranged at the at least one second opening. The threaded nut may for example be welded at the at least one second opening.

According to an example, the method comprising the further step of: removing the threaded assembling element before applying a torque on the disassembling element.

The threaded assembling element may be a fastener element configured to secure and attach the emissions control device to the aftertreatment arrangement. The fastener element is configured to be received in the at least one first opening of the housing of the emissions control device. The fastener element will secure and attach the emissions control device to the aftertreatment arrangement, when the fastener element is received in the at least one first opening of the housing and secured to the aftertreatment arrangement. In order to disassembling the emissions control device from the aftertreatment arrangement the threaded assembling element should be removed before applying a torque on the disassembling element.

The threaded assembling element may comprise at least one threaded pin of the aftertreatment arrangement and at least one nut configured to be threaded on the threaded pin. Alternatively, the threaded assembling element may comprise at least one screw, which is configured to be threaded into a threaded bore of the aftertreatment arrangement.

The present disclosure will now, according to an example, be further illustrated with reference to the appended figures.

FIG. 1 schematically illustrates a side view of a vehicle 1 with a combustion engine aftertreatment arrangement 2, comprising an emissions control device 4 according to an example. The vehicle 1 comprises a combustion engine 6, such as an otto engine or a diesel engine. An exhaust system 8 is connected to the combustion engine 6. The exhaust system 8 comprises the aftertreatment arrangement 2. The exhaust system 8 also comprises a pipe 10, which connects the combustion engine 6 to an inlet 12 of the aftertreatment arrangement 2. The aftertreatment arrangement 2 comprises an outlet 14 to which an exhaust pipe 16 is connected. The emissions control device 4 of the combustion engine aftertreatment arrangement 2 is applicable on all sorts of vehicles 1 provided with a combustion engine and may thus relate to heavy vehicles, such as buses, trucks etc., which may be used on public roads and off-roads.

Figure 2:
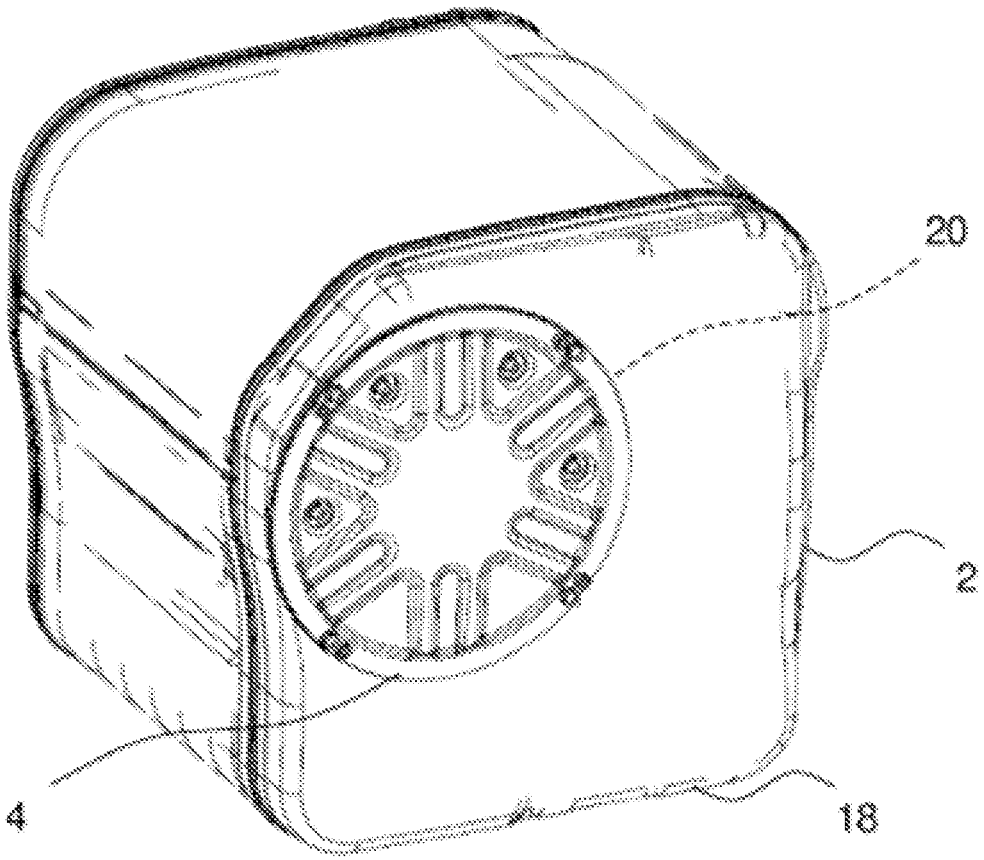
FIG. 2 schematically illustrates a view in perspective of a combustion engine aftertreatment arrangement according to an example.

FIG. 2 schematically illustrates a view in perspective of a combustion engine aftertreatment arrangement 2 according to an example. The aftertreatment arrangement 2 may be combined with a silencer 18. The aftertreatment arrangement 2 may be provided with a cavity 20, which is configured to receive the emissions control device 4. In FIG. 2, the emissions control device 4 is assembled in the aftertreatment arrangement 2.

Figure 3A:
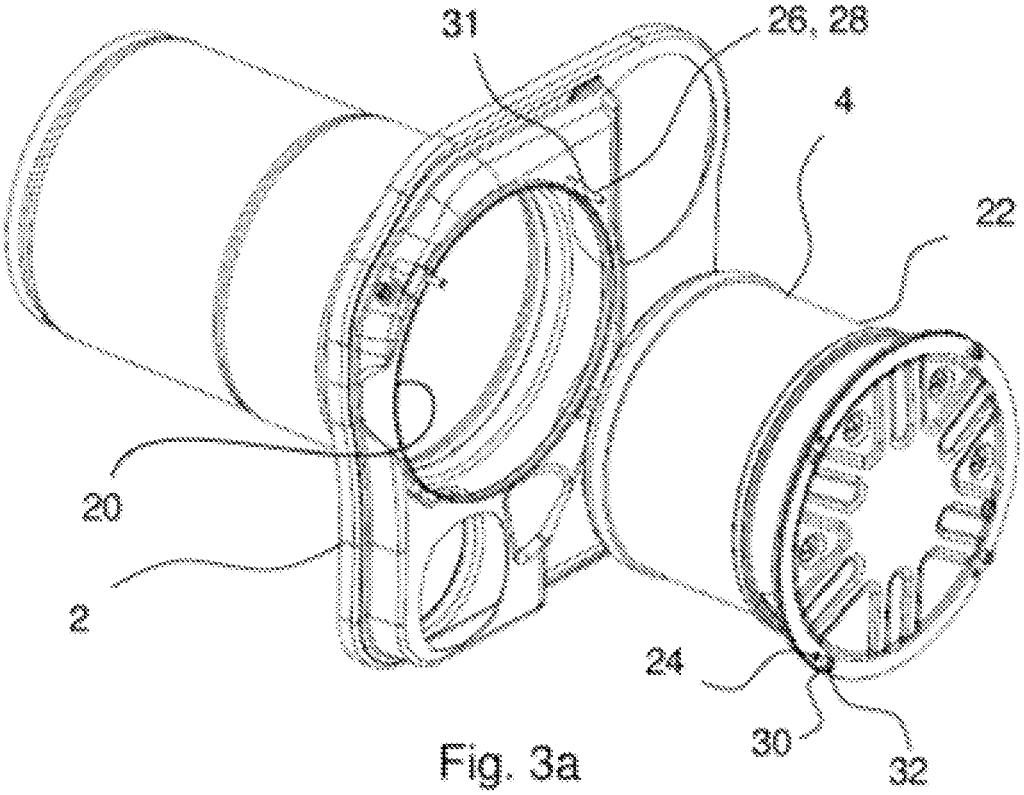
FIG. 3*a* schematically illustrates a view in perspective of a combustion engine aftertreatment arrangement according to an example.

FIG. 3*a* schematically illustrates a view in perspective of a combustion engine aftertreatment arrangement 2 according to an example. In FIG. 3*a*, the emissions control device 4 is arranged at a distance from the aftertreatment arrangement 2. Only a part of the aftertreatment arrangement 2 is shown in FIG. 3*a*. The emissions control device 4 comprises a housing 22. First openings 24 are arranged in the housing 22. The first openings 24 are configured for receiving threaded assembling elements 26. According to FIG. 3*a* the threaded assembling elements 26 are threaded pins 28 arranged in threaded bores 31 of the aftertreatment arrangement 2. The threaded assembling elements 26 are configured for assembly of the emissions control device 4 in the cavity 20 of the aftertreatment arrangement 2. The emissions control device 4 further comprises second openings 30 in the housing 22. The second openings 30 are provided with a thread 32, which will be explained further below.

Figure 3B:
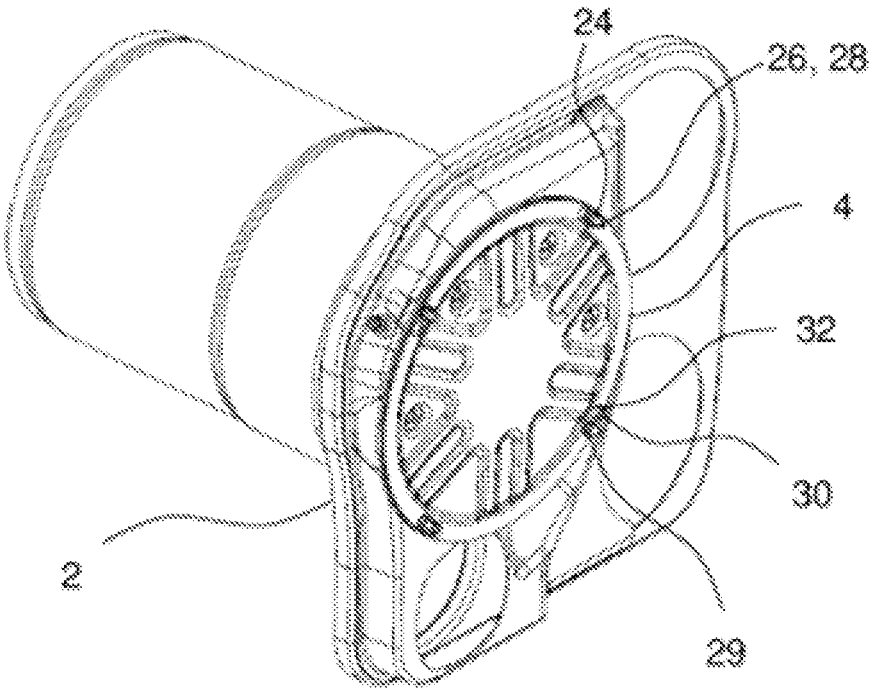
FIG. 3*b* schematically illustrates a view in perspective of a combustion engine aftertreatment arrangement according to an example.

FIG. 3*b* schematically illustrates a view in perspective of a combustion engine aftertreatment arrangement 2 according to an example. In FIG. 3*b*, the emissions control device 4 is arranged in the cavity 20 of the aftertreatment arrangement 2. Only a part of the aftertreatment arrangement 2 is shown in FIG. 3*b*. The threaded assembling elements 26 act as fastener elements, which are configured to attach and secure the emissions control device 4 to the aftertreatment arrangement 2. The threaded assembling elements 26 are received in the first openings 24 of the housing 22 and secured to the aftertreatment arrangement 2 by nuts 29.

Figure 4:
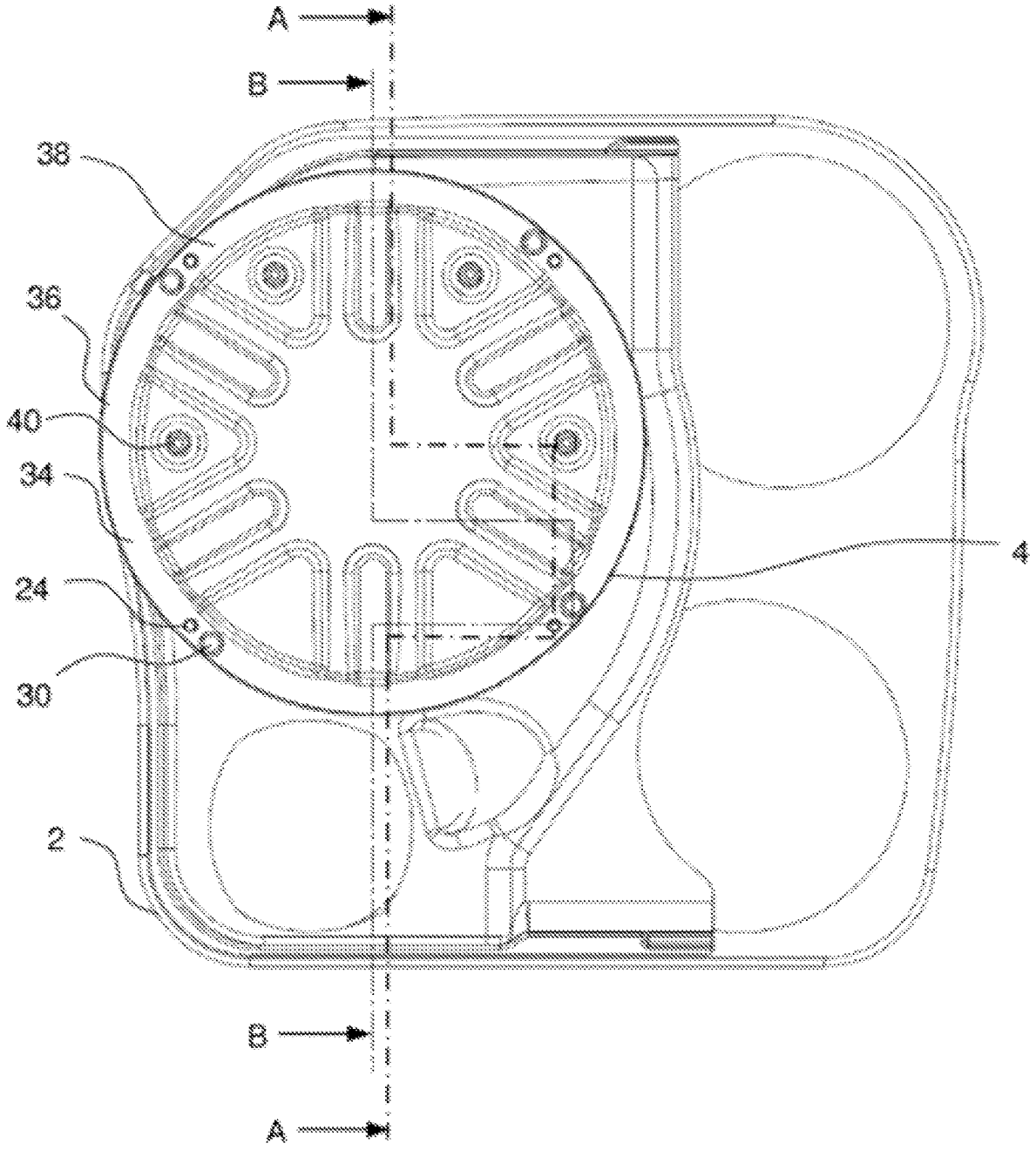
FIG. 4 schematically illustrates a side view of a combustion engine aftertreatment arrangement according to an example.

FIG. 4 schematically illustrates a side view of a combustion engine aftertreatment arrangement 2 according to an example. The housing 22 comprises a flange portion 34, wherein the first and second openings 24, 30 are arranged in the flange portion 34. The first and second openings 24, 30 are evenly distributed in the flange portion 34. The flange portion 34 may be releasably arranged on the housing 22. The flange portion 34 is a rim 36 of a lid 38 of the housing 22. The lid 38 may be releasably arranged on the housing by means of fasteners 40.

Figure 5:
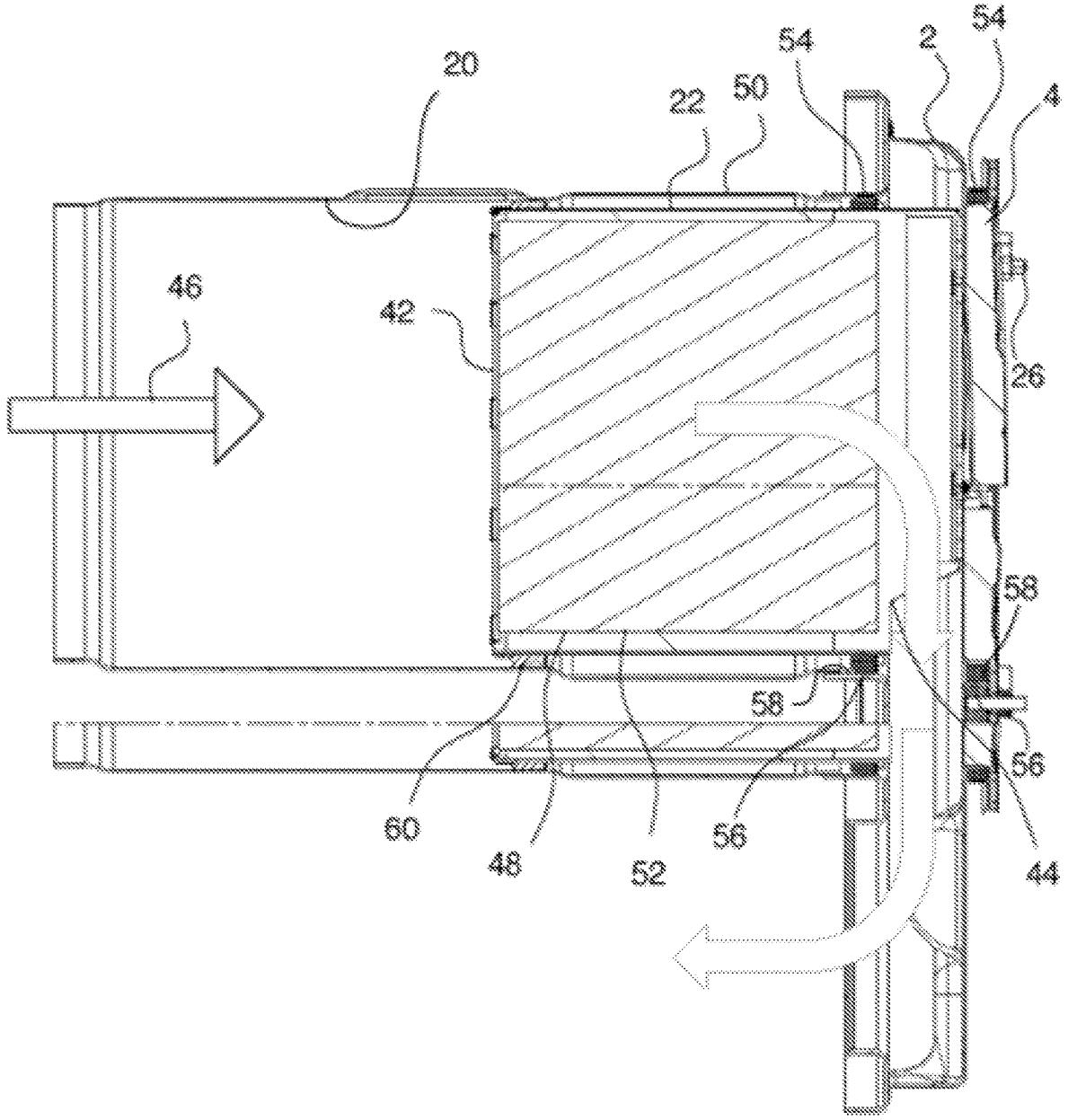
FIG. 5 schematically illustrates a section view along the line A-A in FIG. 4.

FIG. 5 schematically illustrates a section view along the line A-A in FIG. 4. In FIG. 5, the emissions control device 4 is arranged in the cavity 20 of the aftertreatment arrangement 2. The housing 22 is provided with an inlet opening 42 for the exhaust gases and particulate matters emanating from the combustion engine 6 (FIG. 1). In addition, the housing 22 is provided with an outlet opening 44 for the exhaust gases and particulate matters emanating from the combustion engine 6. Thus, the housing 22 is configured to direct a flow of exhaust gases and particulate matters from the inlet opening 42 towards the outlet opening 44. Arrows 46 in FIG. 5 indicate the flow of exhaust gases and particulate matters. The housing 22 is configured for accommodating an emissions control substrate 48. The housing 22 may be a filter housing 50 configured for accommodating a particulate filter substrate 52. The flow of exhaust gases and particulate matters is directed through the emissions control substrate 48.

The housing comprises two sealing elements 54, which are provided with radially directed sealing surfaces 56. The radially directed sealing surfaces 56 of the sealing elements 54 are arranged in contact with circumferential surfaces 58 in the cavity 20 of the aftertreatment arrangement 2. The sealing elements 54 are compressed in a radial direction when assembling the emissions control device 4 in the aftertreatment arrangement 2. Thus, when the emissions control device 4 is assembled in the aftertreatment arrangement 2, the sealing elements 54 are compressed in a radial direction.

The housing 22 comprises a suspension element 60, which is configured to be compressed in a radial direction when assembling the emissions control device 4 in the aftertreatment arrangement 2. Thus, when the emissions control device 4 is assembled in the aftertreatment arrangement 2, the suspension element 60 is compressed in a radial direction. In FIG. 5 the threaded assembling elements 26 attach and secure the emissions control device 4 to the aftertreatment arrangement 2.

Figure 6:
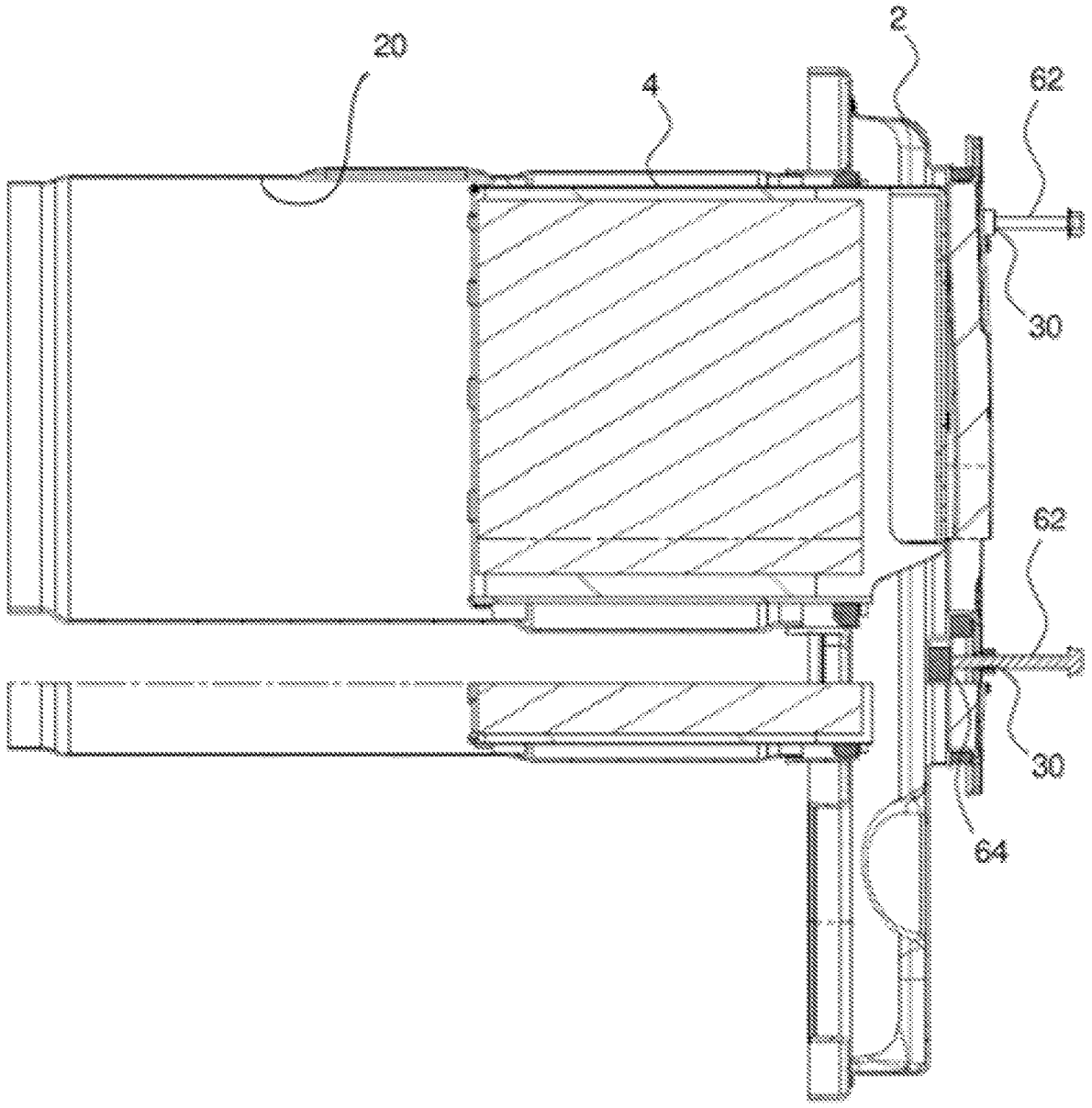
FIGS. 6 and 7 schematically illustrate section views along the line B-B in FIG. 4.
Figure 7:
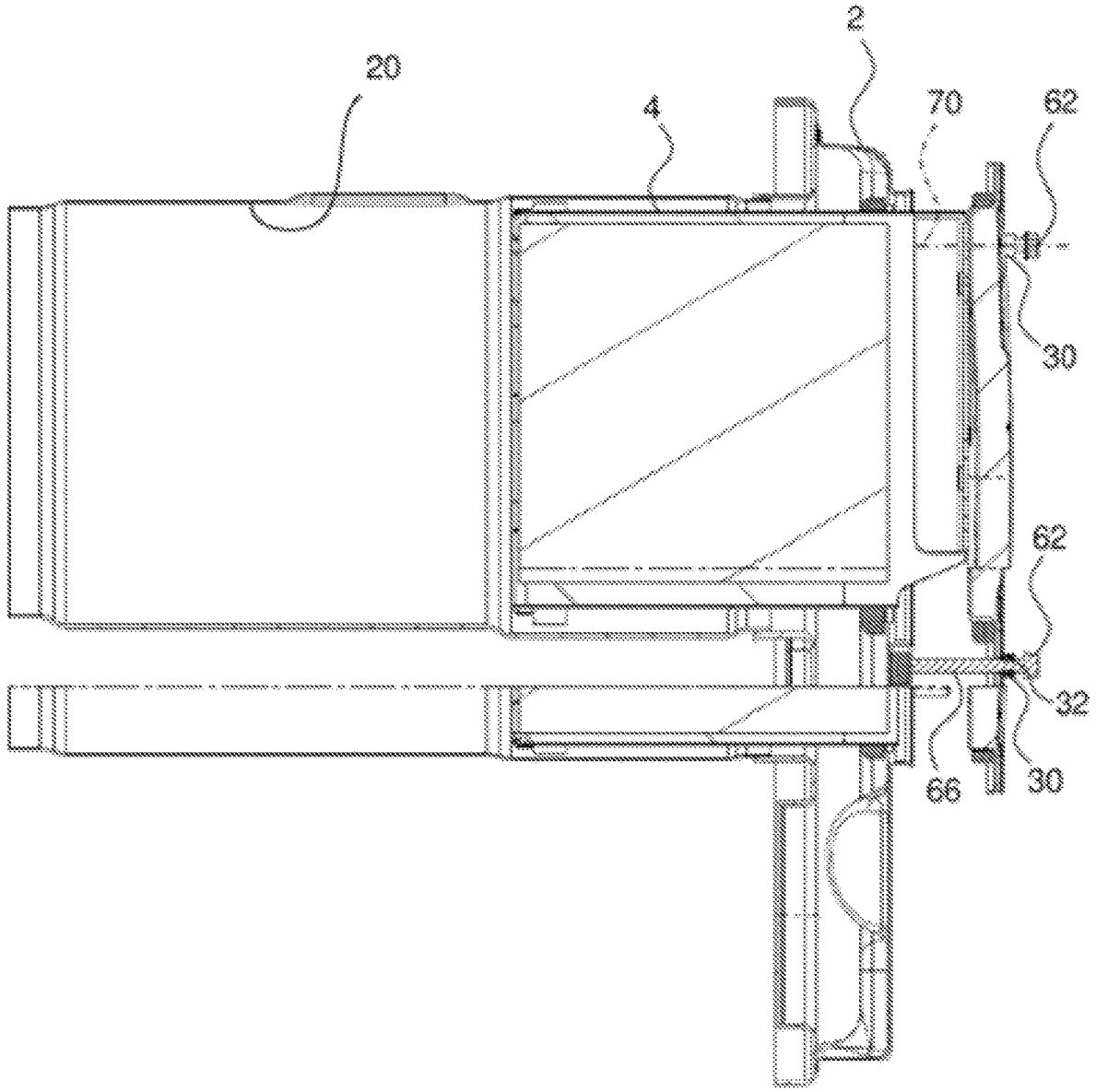

FIGS. 6 and 7 schematically illustrate section views along the line B-B in FIG. 4. In FIG. 6 threaded disassembling elements 62 have been positioned in the threaded second openings 30. Thus, the second openings 30 are configured for receiving the threaded disassembling elements 62. The threaded disassembling elements 62 are configured for disassembly of the emissions control device 4 from the cavity 20 of the aftertreatment arrangement 2. The threaded disassembling elements 62 has in FIG. 6 been rotated, so that that the disassembling elements 62 have been moved in an axial direction towards abutment surfaces 64 of the aftertreatment arrangement 2.

In FIG. 7, a torque has been applied on the disassembling elements 62, so that threads 66 of the disassembling elements 62 have exert a force on threads 32 of the second opening 30 in a direction of a center axis 70 of the second opening 30, which axial force has pushed the emissions control device 4 out of a cavity 20 of the aftertreatment arrangement 2. The threaded assembling elements 26 (FIG. 5) have been removed before applying a torque on the disassembling elements 62.

Figure 8:
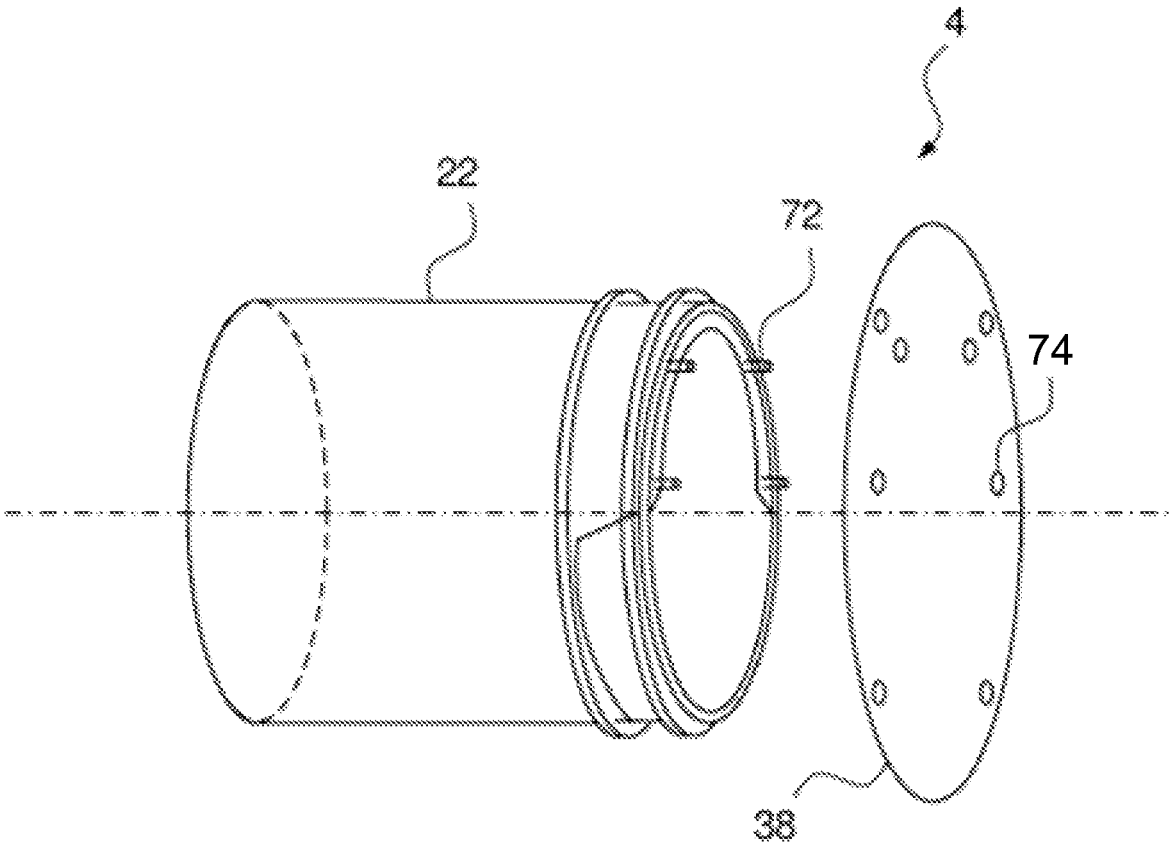
FIG. 8 schematically illustrates a view in perspective of an emissions control device according to an example.

FIG. 8 schematically illustrates a view in perspective of an emissions control device 4 according to an example. The lid 38 of the housing 22 has been released from the housing 22. The housing 22 is provided with threaded pins 72. Corresponding holes 74 is configured and arranged in the lid 38 for receiving the threaded pins 72. The lid 38 may be releasably arranged on the housing 22 by means of other type of fasteners.

Figure 9:
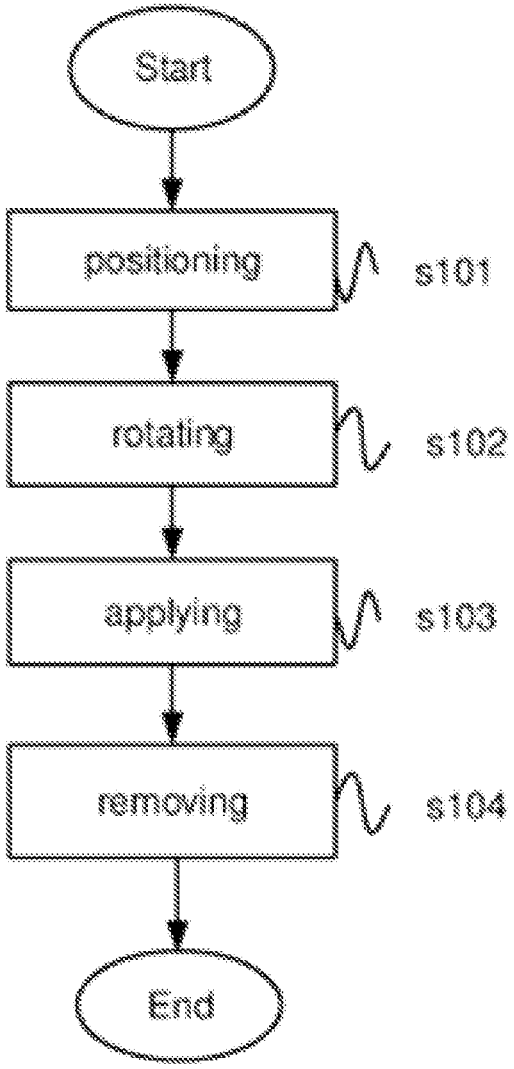
FIG. 9 illustrates a flow chart for a method, for disassembling an emissions control device from a combustion engine aftertreatment arrangement according to an embodiment.

FIG. 9 illustrates a flow chart for a method, for disassembling an emissions control device 4 from a combustion engine aftertreatment arrangement 2 according to an embodiment. The emissions control device 4 is shown in FIGS. 1-8 and comprising a housing 22 configured for accommodating an emissions control substrate 48, first openings 24 in the housing 22, which first openings are configured for receiving a threaded assembling element 26, and threaded second openings 30 in the housing 22 configured for receiving a threaded disassembling element 62. The method comprising the steps of positioning s101 the threaded disassembling element 66 in at least one threaded second opening 30, rotating s102 the disassembling element 62, so that the disassembling element 62 moves in an axial direction towards an abutment surface 64 of the aftertreatment arrangement 2, and applying s103 a torque on the disassembling element 62, so that the threads 66 of the disassembling element 62 exerts a force on the threads 32 of the second opening 30 in a direction of a center axis 70 of the second opening 30, which axial force pushes the emissions control device 4 out of a cavity 20 of the aftertreatment arrangement 2.

The method comprising the further step of removing s104 the threaded assembling element 26 before applying a torque on the disassembling element 62.

The foregoing description of the examples has been furnished for illustrative and descriptive purposes. It is not intended to be exhaustive, or to limit the examples to the variants described. Many modifications and variations will obviously be apparent to one skilled in the art. The examples have been chosen and described in order to best explicate principles and practical applications, and to thereby enable one skilled in the art to understand the examples in terms of its various examples and with the various modifications that are applicable to its intended use. The components and features specified above may, within the framework of the examples, be combined between different examples specified.

The invention claimed is:

1. An emissions control device for a combustion engine aftertreatment arrangement, the emissions control device comprising:

a housing configured for accommodating an emissions control substrate;

at least one first opening in the housing, which at least one first opening is configured for receiving a threaded assembling element, which threaded assembling element is configured for assembly of the emissions control device in a cavity of the aftertreatment arrangement; and at least one second opening in the housing, wherein the at least one second opening is provided with a thread, configured for receiving the threaded disassembling element, which threaded disassembling element is configured such that when manipulated, said threaded disassembling element applies a force between the emission control device and the aftertreatment arrangement thereby facilitating removal of the emissions control device from the cavity of the aftertreatment arrangement.

2. The device according to claim 1, wherein the housing comprises a flange portion, wherein the at least one first opening and the at least one second opening are arranged in the flange portion.

3. The device according to claim 2, wherein at least two first openings are evenly distributed in the flange portion.

4. The device according to claim 1, wherein at least two second openings are evenly distributed in the flange portion.

5. The device according to claim 2, wherein the flange portion is releasably arranged on the housing.

6. The device according to claim 2, wherein the flange portion is a rim of a lid of the housing, the lid being releasably arranged on the housing.

7. The device according to claim 1, wherein the housing comprises at least one sealing element, which is provided with a radially directed sealing surface.

8. The device according to claim 7, wherein the at least one sealing element is configured to be compressed in a radial direction when assembling the emissions control device in the aftertreatment arrangement.

9. The device according to claim 1, wherein the housing comprises a suspension element, which is configured to be compressed in a radial direction when assembling the emissions control device in the aftertreatment arrangement.

10. The device according to claim 1, wherein the housing is a filter housing configured for accommodating a particulate filter substrate.

11. The device according to claim 1, wherein threaded disassembling element is configured such that when manipulated, said threaded disassembling element moves in a direction towards an abutment surface of the aftertreatment arrangement and also exerts a force on the surface of the at least one second opening, which, in turn, creates a force that pushes the emissions control device in a direction away from the cavity of the aftertreatment arrangement.

12. A combustion engine aftertreatment arrangement, comprising an emissions control device comprising:

a housing configured for accommodating an emissions control substrate;

at least one first opening in the housing, which at least one first opening is configured for receiving a threaded assembling element, which threaded assembling element is configured for assembly of the emissions control device in a cavity of the aftertreatment arrangement; and at least one second opening in the housing, wherein the at least one second opening is provided with a thread, configured for receiving the threaded disassembling element, which threaded disassembling element is configured such that when manipulated, said threaded disassembling element applies a force between the emission control device and the aftertreatment arrangement thereby facilitating removal of the emissions control device from the cavity of the aftertreatment arrangement.

13. The arrangement according to claim 12, wherein the threaded assembling element comprises at least one threaded pin of the aftertreatment arrangement and at least one nut configured to be threaded on the threaded pin.

14. The arrangement according to claim 12, wherein the threaded assembling element comprises at least one screw, which is configured to be threaded into a threaded bore of the aftertreatment arrangement.

15. The arrangement according to claim 12, wherein the threaded assembling element is a fastener element configured to attaching the emissions control device to the aftertreatment arrangement.

16. The arrangement according to claim 12, wherein the threaded disassembling element comprises a screw.

17. A vehicle comprising a combustion engine aftertreatment arrangement, which comprises an emissions control device comprising:

a housing configured for accommodating an emissions control substrate;

at least one first opening in the housing, which at least one first opening is configured for receiving a threaded assembling element, which threaded assembling element is configured for assembly of the emissions control device in a cavity of the aftertreatment arrangement; and at least one second opening in the housing, wherein the at least one second opening is provided with a thread, configured for receiving the threaded disassembling element, which threaded disassembling element is configured such that when manipulated, said threaded disassembling element applies a force between the emission control device and the aftertreatment arrangement thereby facilitating removal of the emissions control device from the cavity of the aftertreatment arrangement.

18. A method for disassembling an emissions control device from a combustion engine aftertreatment arrangement, the emissions control device comprising: a housing configured for accommodating an emissions control substrate; at least one first opening in the housing, which at least one first opening is configured for receiving a threaded assembling element; and at least one threaded second opening in the housing configured for receiving a threaded disassembling element, wherein the method comprising the steps of:

positioning the threaded disassembling element in the at least one threaded second opening;

rotating the disassembling element, so that the disassembling element moves in an axial direction towards an abutment surface of the aftertreatment arrangement; and applying a torque on the disassembling element, so that the threads of the disassembling element exert a force on the threads of the second opening in a direction of a center axis of the second opening, which axial force moves the emissions control device in a direction away from a cavity of the aftertreatment arrangement.

19. The method according to claim 18, wherein the method comprising the further step of:

removing the threaded assembling element before applying a torque on the disassembling element.

* * * * *